US007192238B2

(12) United States Patent
Theurer

(10) Patent No.: US 7,192,238 B2
(45) Date of Patent: Mar. 20, 2007

(54) METHOD FOR LOADING A FREIGHT TRAIN

(75) Inventor: Josef Theurer, Vienna (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 157 days.

(21) Appl. No.: 10/622,288

(22) Filed: Jul. 18, 2003

(65) Prior Publication Data

US 2004/0018072 A1 Jan. 29, 2004

(30) Foreign Application Priority Data

Jul. 23, 2002 (AT) ..... GM495/2002
Mar. 7, 2003 (AT) ..... GM153/2003

(51) Int. Cl.
*B65G 67/10* (2006.01)

(52) U.S. Cl. ..... 414/339; 414/809; 104/2; 104/3; 104/5; 104/8; 105/238; 105/247; 105/355; 105/396; 105/404

(58) Field of Classification Search ..... 414/339, 414/809; 104/2, 3, 5, 8; 105/238, 247, 355, 105/396, 404
See application file for complete search history.

(56) References Cited

U.S. PATENT DOCUMENTS 3,064,837 A * 11/1962 Manney ..... 414/528
3,842,994 A * 10/1974 Theurer et al. ..... 414/339
4,576,538 A * 3/1986 Theurer et al. ..... 414/339
4,809,617 A * 3/1989 Theurer et al. ..... 105/239
5,029,532 A * 7/1991 Snead ..... 105/239
5,151,002 A * 9/1992 Theurer et al. ..... 414/339
5,301,548 A * 4/1994 Theurer ..... 73/146
5,944,469 A * 8/1999 Theurer et al. ..... 414/339

FOREIGN PATENT DOCUMENTS

EP 0429713 6/1991
EP 0 429 713 B1 9/1992

* cited by examiner

*Primary Examiner*—Eileen D. Lillis
*Assistant Examiner*—Michael Lowe
(74) *Attorney, Agent, or Firm*—Collard & Roe, P.C.

(57) ABSTRACT

In a method of loading several like coupled storage cars with bulk material, a first storage car is first filled with the bulk material by reducing the conveying speed mode of a bottom conveyor band in the first storage car to a bulk material storing speed mode while a transfer conveyor band of the adjacent storage car fills the first storage car, the storing speed mode of the bottom conveyor band in the first storage car is automatically adjusted in response to a measured amount of the bulk material accumulating in a pile so that the first storage car is filled to a maximal height, and after the accumulated pile has reached a forward end position, the conveying speed mode of the bottom conveyor band in the storage car adjacent to, and rearwardly of, the first storage car in the conveying direction is automatically reduced to the storing speed mode.

5 Claims, 2 Drawing Sheets

METHOD FOR LOADING A FREIGHT TRAIN

BACKGROUND OF THE INVENTION

1. Field of the Invention

The present invention related to a method for loading a freight train comprising several like storage cars for bulk material.

2. Description of the Prior Art

European patent No. 0 429 713 B1 describes a freight train with storage cars of the above-indicated type, wherein a sensor device is mounted at the front end of the loading container, in the conveying direction of the bottom conveyor band. The sensor device may be an optical eye or a mechanical sensor for monitoring the maximally acceptable height of the bulk material pile as the transfer conveyor band fills the loading container with the conveyed bulk material.

SUMMARY OF THE INVENTION

It is the primary object of this invention to simplify the loading operation by automatically filling the storage cars.

In a method of loading several like storage cars with bulk material, in which the storage cars are coupled together to form a freight train and each storage car comprises a bottom conveyor band for conveying the bulk material in a conveying direction to a transfer conveyor band projecting from a front end of the storage car, the bulk material is conveyed at a conveying speed mode from a bulk material delivery point by the bottom and transfer conveyor bands arranged successively in the conveying direction, the above and other objects are accomplished according to the invention by the steps of first filling a first one of the storage cars with the bulk material by reducing the conveying speed mode of the bottom conveyor band in the first storage car to a bulk material storing speed mode while the transfer conveyor band of the adjacent storage car fills the first storage car, the storing speed mode of the bottom conveyor band in the first storage car being automatically adjusted in response to a measured amount of the bulk material accumulating in a pile in the first storage car so that the first storage car is filled to a maximal height, and after the accumulated pile of bulk material in the first storage car has reached a forward end position, automatically reducing the conveying speed mode of the bottom conveyor band in the storage car adjacent to, and rearwardly of, the first storage car in the conveying direction to the storing speed mode.

This method enables the storage cars to be automatically filled to their maximum capacity even if different amounts of bulk material are delivered so that an economically efficient filling operation of the freight train is always assured. Since the storage cars are filled automatically, the optimal operation does not depend on the attention and skill of an operator. In addition, the safety of the operation is considerably enhanced since it is not longer necessary for an operator to move from storage car to storage car along the train on a neighboring track, where the operator may be subjected to dangers of a passing train.

BRIEF DESCRIPTION OF THE DRAWING

The above and other objects, features and advantages of the present invention will become more apparent from the following detailed description of a now preferred embodiment thereof, taken in conjunction with the accompanying, somewhat schematic drawing wherein.

DETAILED DESCRIPTION OF THE PREFERRED EMBODIMENT

Figures 1, 2, 3:
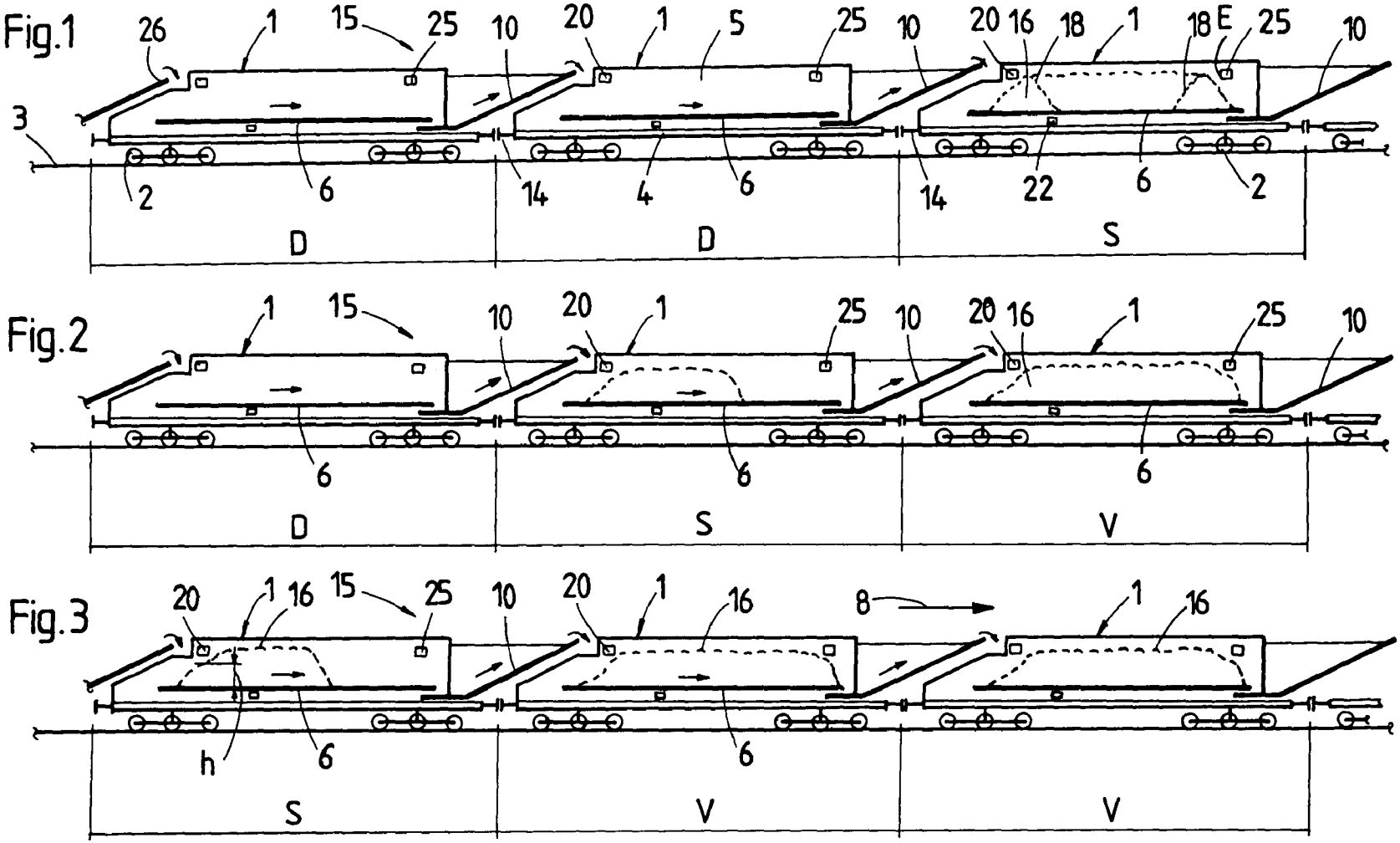
FIGS. 1 to 3 show a freight train comprising several like storage cars for bulk material in different loading conditions.

Referring now to the drawing, there is shown a freight train 15 comprising at least two like storage cars 1 for bulk material 16 to be stored and/or transported. The train may comprise any number of storage cars coupled together by couplings 14. The storage cars comprise loading containers 5 extending in a longitudinal direction and mounted on car frames 4. The car frames are supported on undercarriages 2 for movement on track 3 in an operating direction indicated by arrow 8.

Each storage car 1 comprises a bottom conveyor band 6 which extends in the longitudinal direction in loading container 5 for conveying bulk material 16 in a conveying direction from a rear end 19 to a front end 9 of the loading container. The bottom conveyor band forms the bottom of loading container 5 and is connected to drive 7 for driving the bottom conveyor band in the conveying direction.

A transfer conveyor band 10 is so arranged at front end 9 of loading container 5 that it receives the conveyed bulk material from bottom conveyor band 6, and it projects from front end 9 to loading container 5 of a preceding one of the two storage cars 1 to transfer conveyed bulk material 16 to loading container 5 of the preceding storage car where the transferred bulk material forms bulk material pile 18. As shown, an input end of transfer conveyor band 10 subtends discharge end 11 of bottom conveyor band 6 so that the conveyor bands overlap, and it is mounted on front end 12 of car frame 4. It rises obliquely from car frame front end 12 to its discharge end 17 and is driven by drive 13. In this arrangement, the bottom and transfer conveyor bands 6, 10 of all the storage cars 1 of freight train 15 form a continuous bulk material conveyor, bulk material 16 being transferred in the conveying direction from each discharge end 17 of transfer conveyor band 10 of a succeeding storage car 1 to bottom conveyor band 6 of loading container 5 of a preceding storage car.

Bulk material 16 is simply conveyed in conveying direction 8 through loading containers 5 from storage car to storage car from the bulk material delivery point 26 at the back of train 15 to the front of the train at a high conveying speed mode D of conveyor bands 6, 10. However, when drive 7 of bottom conveyor band 6 is actuated to reduce the conveying speed mode to a storing speed mode S, the conveyed bulk material forms pile 18 in loading container 5 and thus stores the bulk material in the loading container.

Figure 4:
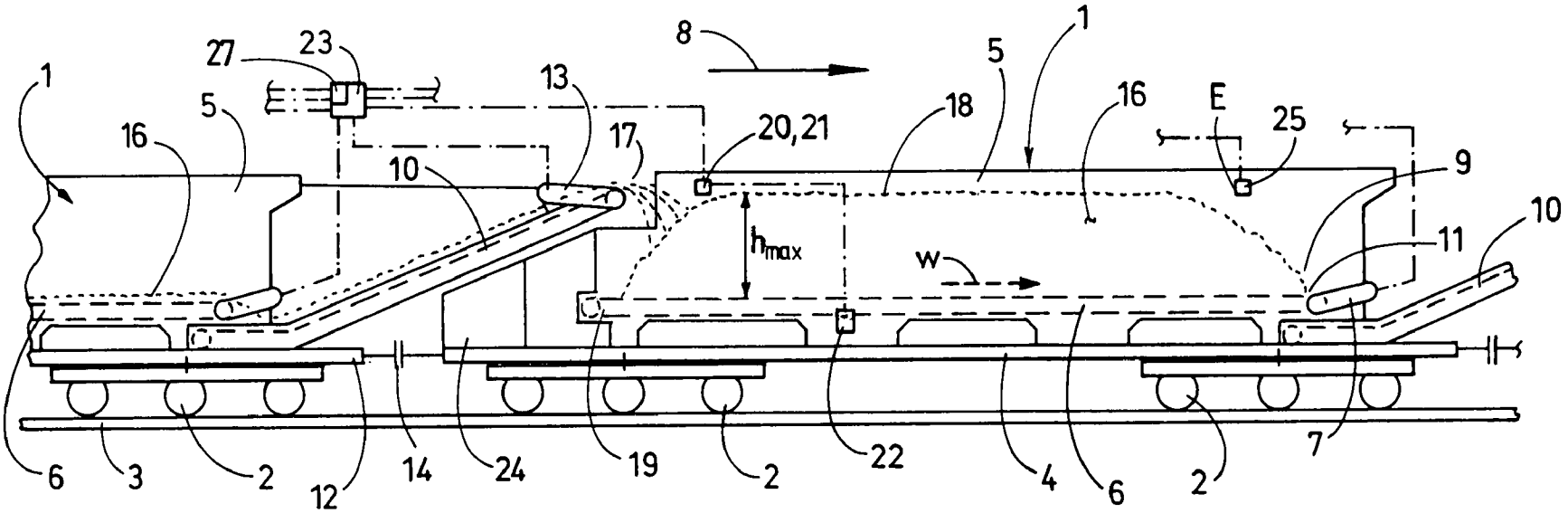
FIG. 4 is an enlarged side view showing the two storage cars in detail.

Sensor device 20 is mounted in loading container 5 of the preceding storage car at its rear end 19 for continuously sensing the filling state so that it may determine a maximally acceptable height hmax of bulk material pile 18. In the preferred embodiment, the sensor device is a contactless laser distance measuring device 21 which continuously senses bulk material pile 18. However, the sensor device may take any desired form, such as an optical eye or a mechanically operated sensor. In the illustrated embodiment, loading container 5 further comprises a device 22 for measuring conveying path of the bottom conveyor band, which is indicated in FIG. 4 by arrow w shown in broken lines. The conveying path measuring device 22 is connected to sensor device 20, 21 in a circuit comprising central control 23 for automatically actuating drives 7, 13 for the bottom and transfer conveyor bands, power being delivered to the actuating drives from power source 24. Such a freight train has been disclosed and claimed in copending U.S. Pat. No. 6,892,648.

The method of loading several like storage cars 1 with bulk material 16 according to the present invention will now be described:

As shown, storage cars 1 are coupled together to form freight train 15, and each storage car comprises bottom conveyor band 6 for conveying the bulk material in a conveying direction 8 to transfer conveyor band 10 projecting from a front end of the storage car. The bulk material is conveyed at a conveying speed mode D from bulk material delivery point 26 by the bottom and transfer conveyor bands 6, 10 arranged successively in the conveying direction.

As shown in FIG. 1, the first storage car 1 in conveying direction 8 is first filled with bulk material 16 by reducing the conveying speed mode D of bottom conveyor band 6 in the first storage car to a bulk material storing speed mode S, which is lower than the conveying speed mode of the bottom and transfer conveyor bands in the other storage cars, while the transfer conveyor band of the adjacent storage car fills the first storage car as the bottom and transfer conveyor bands in all but the first storage cars are operated at the high conveying speed mode D. The transfer conveyor band 10 of the first storage car is kept immobile.

The bulk material is stored in the first storage car by automatically adjusting storing speed mode S of bottom conveyor band 6 in the first storage car in response to a measured amount of the bulk material accumulating in pile 18 in the first storage car so that the first storage car is filled to a maximal height hmax, see FIG. 4. The amount of accumulating pile 18 of bulk material is measured by a contactless sensing of the height of the pile by laser distance measuring device 21.

As shown in FIG. 2, after accumulated pile 18 of bulk material 16 in the first storage car has reached a forward end position E, conveying speed mode D of bottom conveyor band 10 in the storage car adjacent to, and rearwardly of, the first storage car in the conveying direction is automatically reduced to the storing speed mode S. In this way, the cycle of filling adjacent storage cars to the maximal height is repeated.

The mentioned forward end position E of bulk material pile 18 is sensed by sensor device 25 at the front of storage car 1. The sensor device is an optical eye extending tranversely to conveying direction 8. Preferably, sensor device 25 is so positioned that it controls the movement of bottom conveyor band 6 so that it advances a little sufficiently to empty bulk material on transfer conveyor band 10 in the adjacent storage car into the first storage car until pile 18 has reached forward end position E, while the conveying speed mode of bottom conveyor band 6 in the adjacent storage car is reduced to storing speed mode S. At this point, the filling and storing operation is concluded, and the first storage car has been fully filled in loaded condition V over the entire length of its bottom conveyor band 6 to its maximal accepted height hmax. Alternatively, the advancement of pile 18 of the bulk material may be controlled by conveying path measuring device 22.

After the storage car adjacent to, and rearwardly of, the first storage car in conveying direction 8 has been filled with the bulk material, front sensor device 25 in the next adjacent storage car automatically reduces the conveying speed mode D of the conveyor bands in that next adjacent car to storing speed mode S to repeat the loading cycle (see FIG. 3) until all storage cars 1 of freight train 15 have been filled. In this connection, it is advantageous to transmit the loading condition of the storage car being filled with the bulk material to a display 27 of control device 23 controlling the speed of conveyor bands 6, 10. Control signals from sensor devices 20, 25 are wirelessly transmitted to control 23, and display 27 permits the optical viewing of the loading condition of the freight train at all times.

Storage cars 1 of freight train 15 may be automatically unloaded in a similar fashion, the foremost storage car being first emptied until sensor device 25 detects the end of the rearmost bulk material pile 18, and so on to the succeeding storage cars.

What is claimed is:

1. A method of loading several like storage cars with bulk material, the storage cars being coupled together to form a freight train, and each storage car comprising a bottom conveyor band for conveying the bulk material in a conveying direction to a transfer conveyor band projecting from a front end of the storage car, the bulk material being conveyed at a conveying speed mode from a bulk material delivery point by the bottom and transfer conveyor bands arranged successively in the conveying direction, comprising the steps of (a) first filling a first one of the storage cars with the bulk material by reducing the conveying speed mode of the bottom conveyor band in the first storage car to a bulk material storing speed mode while the transfer conveyor band of the adjacent storage car fills the first storage car, sensing a predetermined maximum level of the bulk material accumulating in a pile in the first storage car at a rear end thereof in the conveying direction, and automtically adjusting the storing speed mode of the bottom conveyor band in the first storage car in response to the sensed predetermined maximal level of the bulk material pile so that the first storage car is filled to a maximum capacity, and (b) after the accumulated pile of bulk material in the first storage car has reached a forward end position, automatically reducing the conveying speed mode of the bottom conveyor band in the adjacent storage car rearwardly of the first storage car in the conveying direction to the storing speed mode.

2. The method of claim 1, comprising the further step of emptying bulk material on the transfer conveyor band in the adjacent storage car into the first storage car while the conveying speed mode of the bottom conveyor band in the adjacent storage car is reduced to the storing speed mode.

3. The method of claim 1, wherein the amount of the accumulating pile of bulk material is measured by a contactless sensing of the height of the pile.

4. The method of claim 1, comprising the further step of sensing the forward end position of the pile of bulk material.

5. The method of claim 1, comprising the further step of wirelessly transmitting a signal indicating the level of the accumulated pile storage car being filled with the bulk material to a display of a control device controlling the speed of the conveyor bands.

* * * * *